US007955227B2

(12) United States Patent
Chen

(10) Patent No.: US 7,955,227 B2
(45) Date of Patent: Jun. 7, 2011

(54) BICYCLE TRAINER

(75) Inventor: Mu-Tsun Chen, Miaoli County (TW)

(73) Assignee: Giant Manufacturing Co., Ltd., Taichung Hsien (TW)

( * ) Notice: Subject to any disclaimer, the term of this patent is extended or adjusted under 35 U.S.C. 154(b) by 0 days.

(21) Appl. No.: 12/605,380

(22) Filed: Oct. 26, 2009

(65) Prior Publication Data

US 2010/0317493 A1 Dec. 16, 2010

(30) Foreign Application Priority Data

Jun. 11, 2009 (TW) ..... 98119552 A

(51) Int. Cl.
*A63B 22/06* (2006.01)
*A63B 69/16* (2006.01)
*F16D 57/02* (2006.01)

(52) U.S. Cl. ..... 482/58; 482/61; 188/296

(58) Field of Classification Search ..... 482/51–53, 482/57–59, 61, 63, 72–73, 111–113, 121, 482/127; 188/166, 266.3, 290, 296, 307; *A63B 22/06, 69/16; F16D 57/02*
See application file for complete search history.

(56) References Cited

U.S. PATENT DOCUMENTS

| | | | | |
|---|---|---|---|---|
| 584,989 | A * | 6/1897 | Davis | 482/59 |
| 4,666,386 | A * | 5/1987 | Winkler et al. | 418/267 |
| 4,789,153 | A * | 12/1988 | Brown | 482/111 |
| 5,346,234 | A * | 9/1994 | Kadaja | 280/216 |
| 5,795,270 | A * | 8/1998 | Woods et al. | 482/72 |
| 6,561,955 | B1 * | 5/2003 | Dreissigacker et al. | 482/57 |
| 7,628,739 | B2 * | 12/2009 | Gearon | 482/112 |
| 2007/0179025 | A1 * | 8/2007 | Tsai | 482/59 |
| 2008/0305934 | A1 * | 12/2008 | Medina | 482/72 |

* cited by examiner

*Primary Examiner* — Loan Thanh
*Assistant Examiner* — Oren Ginsberg
(74) *Attorney, Agent, or Firm* — CKC & Partners Co., Ltd.

(57) ABSTRACT

A bicycle trainer is disclosed. The bicycle trainer includes a supporting frame, a roller, a runner and at least one vane. The supporting frame suspends at least one bicycle wheel. The roller is connected to the supporting frame via a shaft member. The roller is driven by the bicycle wheel. A runner is coaxially connected to the roller via the shaft. The vane is pivotally connected to an edge of the runner.

7 Claims, 5 Drawing Sheets

BICYCLE TRAINER

RELATED APPLICATIONS

The application claims priority to Taiwan Application Serial Number 98119552, filed Jun. 11, 2009, which is herein incorporated by reference.

BACKGROUND

1. Technical Field

The present disclosure relates to exercise devices. More particularly, the present disclosure relates to a bicycle trainer.

2. Description of Related Art

Living in the highly competitive society for 21st century, people often busy at work and then overlook the importance of health. In order to do some exercises in their daily life, some people place a bicycle trainer indoors. The bicycle trainer can hold a bicycle securely, and makes it possible to ride a bicycle without moving forward. Therefore, people can exercise by riding the bicycle at home without spatial restriction.

In general, the bicycle trainer includes a resistance system. One kind of the resistance system includes a fan, which includes a plurality of vanes. Each vane is fixed to each other. The vane can increase the resistance by the rotation speed of the fan so that it has less reality of the simulation. The other kind of resistance system uses an external magnetism to change the resistance. But, the apparatus of the magnetic resistance system is still complicated.

SUMMARY

According to one embodiment of the present disclosure, a bicycle trainer is disclosed. The bicycle trainer includes a supporting frame, a roller, a runner and at least one vane. The supporting frame suspends at least one bicycle wheel. The roller is connected to the supporting frame via a shaft member. The roller is driven by the bicycle wheel. The runner is coaxially connected to the roller via the shaft. The vane is pivotally connected to an edge of the runner.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
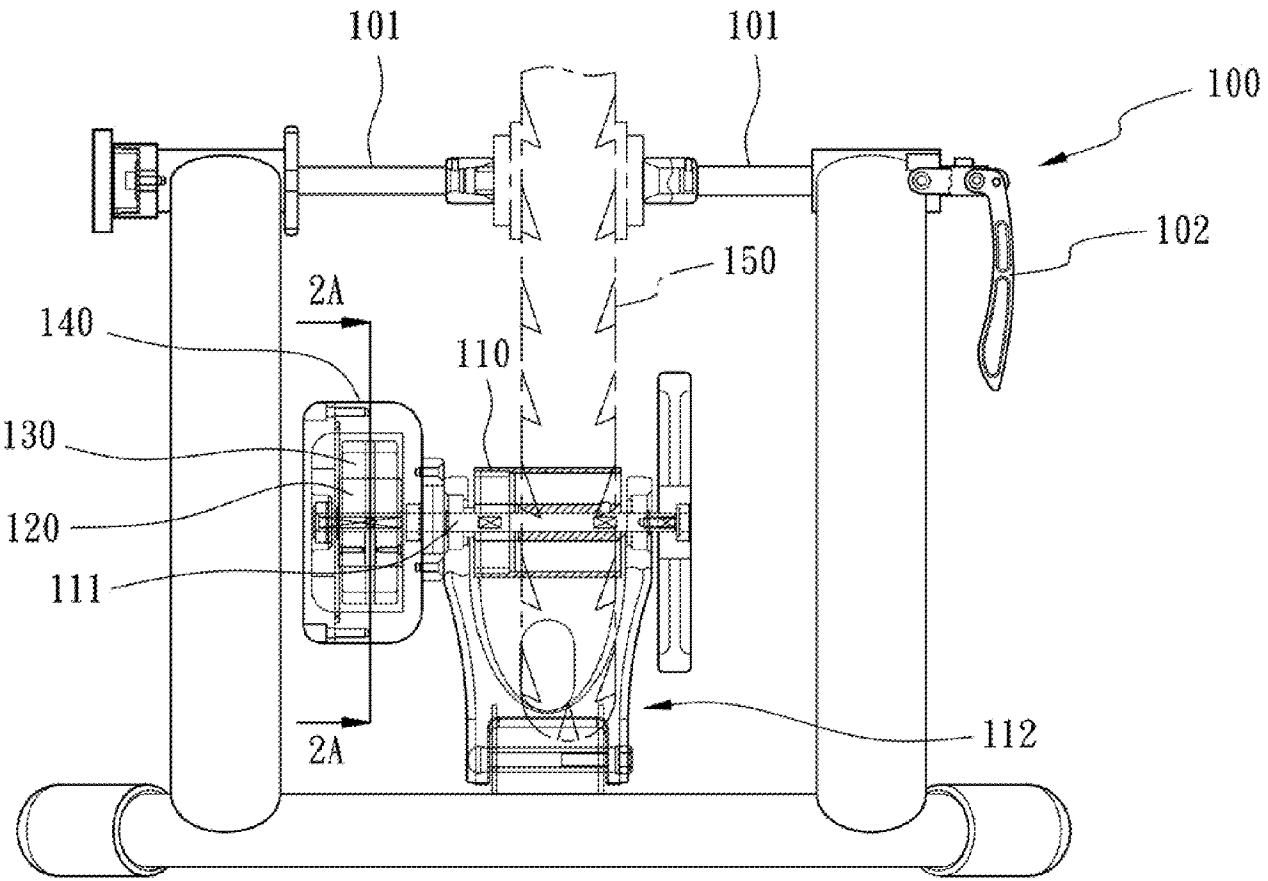
FIG. 1 is a front view of a bicycle trainer according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a front view of a bicycle trainer according to one embodiment of the present disclosure. The bicycle trainer includes a supporting frame 100, a roller 110, a runner 120, a plurality of vane 130 and a housing 140.

The supporting frame 100 includes a couple of clamps 101. The clamps 101 can clamp a bicycle wheel 150 of a bicycle, so that the bicycle wheel 150 is suspendly held securely. The clamp 101 links up with a quick-release member 102. A user can set up or take apart the bicycle wheel 150 from the bicycle trainer by the quick-release member 102 easily.

The roller 110 is connected to a linking frame 112 via a shaft member 111, wherein the linking frame 112 is connected to the supporting frame 100. Therefore, the roller 110 is connected to the supporting frame 100 via the shaft member 111 and the linking frame 112. After the user has set up the bicycle wheel 150 onto the supporting frame 100, the bicycle wheel 150 touches and against the roller 110. Thereafter, when the user starts pedaling the bicycle, the roller 110 will be driven by the bicycle wheel 150.

The runner 120 is coaxially connected to the roller 110 via the shaft member 111. When the roller 110 is driven by the bicycle wheel 150, the runner 120 is in fact being driven simultaneously.

The plurality of vanes 130 are pivotally connected to edges of the runner 120. When the runner 120 is coaxially linked up to the roller 110 to synchronously rotate, the vanes 130 also synchronously rotate with them. When the rotation speed of the runner 120 is increased, the pivotal end of the vanes 130 pivotally fixed to the runner 120 swings outward from the shaft member 111, so the straight-line distance between the opposite end of the vanes 130 and the center of the runner 120 increases when the runner 120 rotates faster. Thus the resistance from the medium is increased, and the user has to exert hardly to drive the bicycle, so that the runner 120 can coaxially link up to the roller 110 to synchronously rotate.

The housing 140 contains the runner 120 and the vanes 130. When the vanes 130 are linked up to the runner 120 to rotate, the medium in the housing 140 gives a resistance to the vanes 130, wherein the direction of the resistance is opposite to the direction of angular motion of the vanes 130. Therefore, it needs more motive power to drive the roller 110 and the runner 120.

Figure 2B:
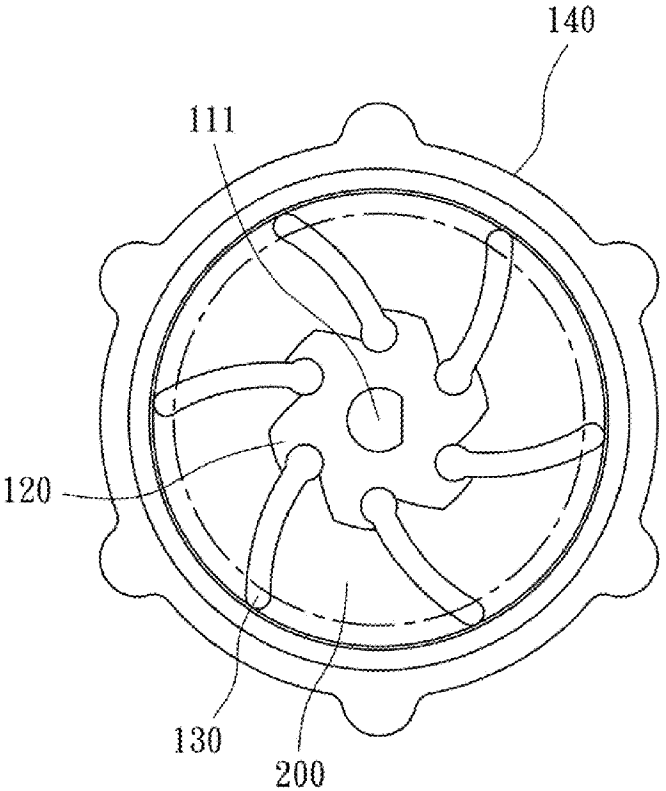
FIG. 2B is a cross-sectional view as FIG. 2A wherein the apparatus in the housing are in use.
Figure 2A:
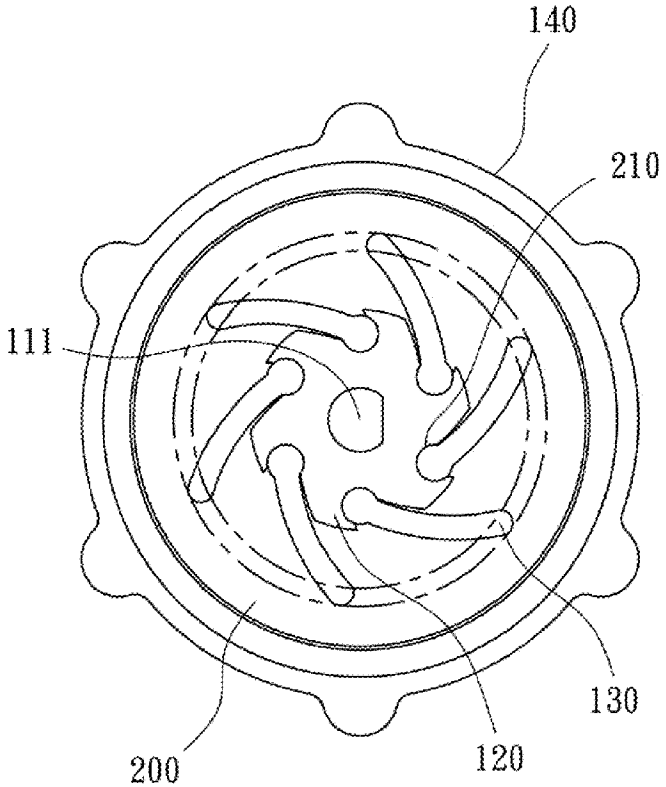
FIG. 2A is a cross-sectional view taken along line 2A-2A wherein the apparatus in the housing are at rest.

Referring to FIG. 2A for a cross-sectional view taken along line 2A-2A wherein the apparatus in the housing are at rest.

The housing 140 contains the runner 120 and the vanes 130. The housing 140 is filled with the damping liquid 200. The runner 120 is plate-shaped. The runner 120 includes a plurality of pivot parts 210. The pivot parts 210 are located on the edge of the runner 120 and the vanes 130 are pivotally connected thereon. When the runner 120 is at rest, the vanes 130 are at normal positions.

FIG. 2B is a cross-sectional view as FIG. 2A wherein the apparatus in the housing is in operation.

In FIG. 1 and FIG. 2B, when the roller 110 is driven by the bicycle wheel 150, the runner 120 in the housing 140 is linked up via the shaft member 111 with the roller 110 to rotate. The vanes 130, which are pivotally connected to the edge of the runner 120, are also linked up with the runner 120 to rotate. When the runner 120 rotate, each of the vanes 130 swings outward from the center of the runner 120 responding to a centrifugal force generated by the angular motion of the runner 120. However, when the vanes 130 swing outward, there is a resistance from the damping liquid 200 exerted to the vanes 130. The direction of the resistance is opposite to the direction of the angular motion of vanes 130. So the resistance is increased as the vanes 130 swings outward and the user has to pedal harder. It increases the reality of the simulation.

The perpendicular distance between the housing 140 and the edge of the runner 120 is longer than the length of the vanes 130. Then, the vanes 130 don't touch the housing when the vanes 130 swing outward to a maximum range. Furthermore, in one preferred embodiment of the present disclosure, the pivot parts 210 can be preset within a range, so that the vanes 130 swing within the preset range.

Figure 3:
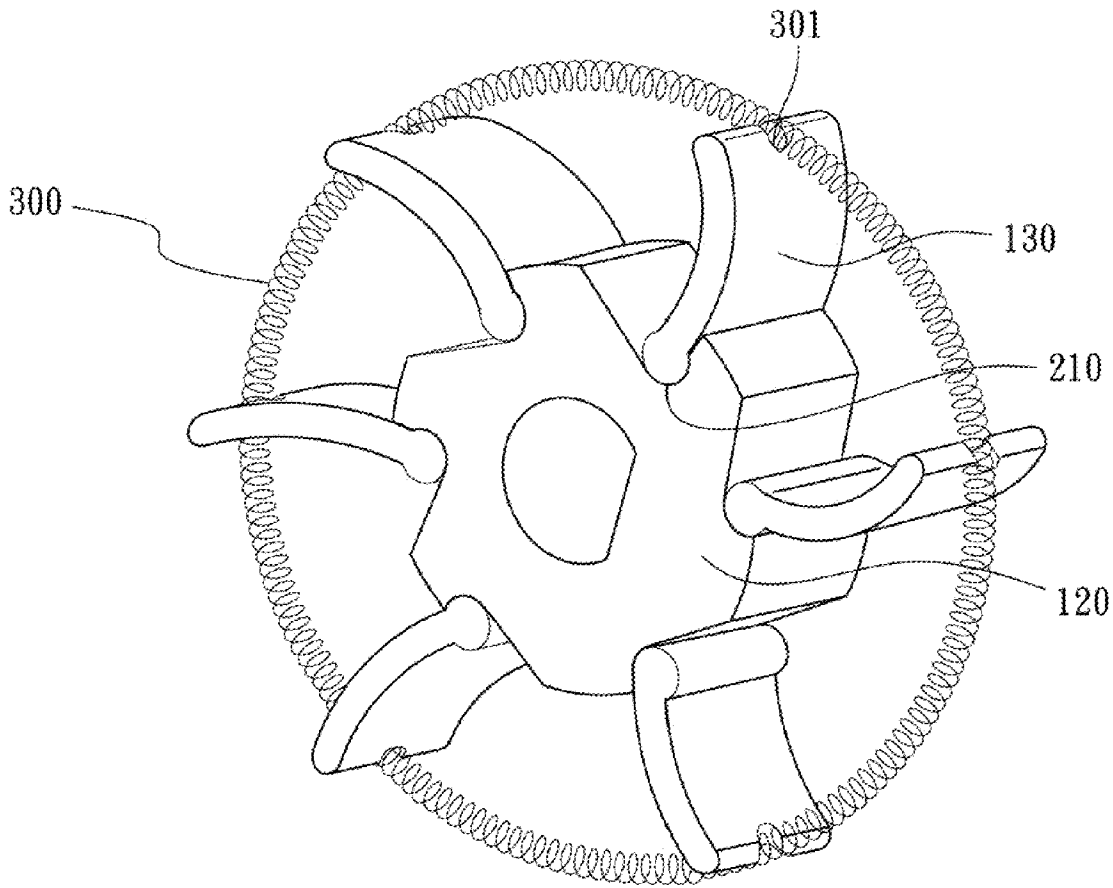
FIG. 3 is a three dimensional view of a bicycle trainer according to a part of another embodiment of the present disclosure.

FIG. 3 is a three dimensional view of a bicycle trainer according to a part of another embodiment of the present disclosure. Compared with the embodiment in FIG. 1, the embodiment in FIG. 3 further includes an elastic member 300, which provides a restoring force for holding the plurality of the vanes 130. The elastic member 300 surrounds the runner 120 and resiliently hoops the plurality of the vanes 130. Each vane 130 includes a linking part 301. The linking part 301 is connected to the elastic member 300. In FIG. 3, the linking part 301 is a recess for holding the elastic member 300. Then, the vanes 130 are in the normal position. When the vanes 130 are linked up with the runner 120 to rotate, there is a restriction from the elastic member 300, so that each vane 130 swings outward equally from the center of the runner 120. So the elastic member 300 can avert each of vanes 130 from having different swinging angels, thus preventing the unstable situation when the user rides the bicycle. It not only prevents hurting the user's legs, but also avoids harming the bicycle wheel and the bicycle trainer.

When the plurality of the vanes 130 swing outward from the center of the runner 120, the elastic member 300 provides a restoring force, which is opposite to the angular motion of the vanes 130. An elastic limit of the elastic member 300 can restrict the maximum swinging range of the vanes 130. Therefore, the resistance the user has to overcome is increased by the elasticity Of the elastic member 300. Besides, when the length of the vanes 130 are shorter than the distance between the housing 140 and the runner 120, the pivot part 210 of the runner 120 can restrict the swinging angle of the vanes 130. If the angle is greater than 90°, the resistance which provides from the medium in the housing 140 is decreased. Therefore, in another preferred embodiment of the present disclosure, the pivot part 210 and the elastic member 300 can be chosen to restrict the swinging angle to a value smaller than 90°.

Figure 4:
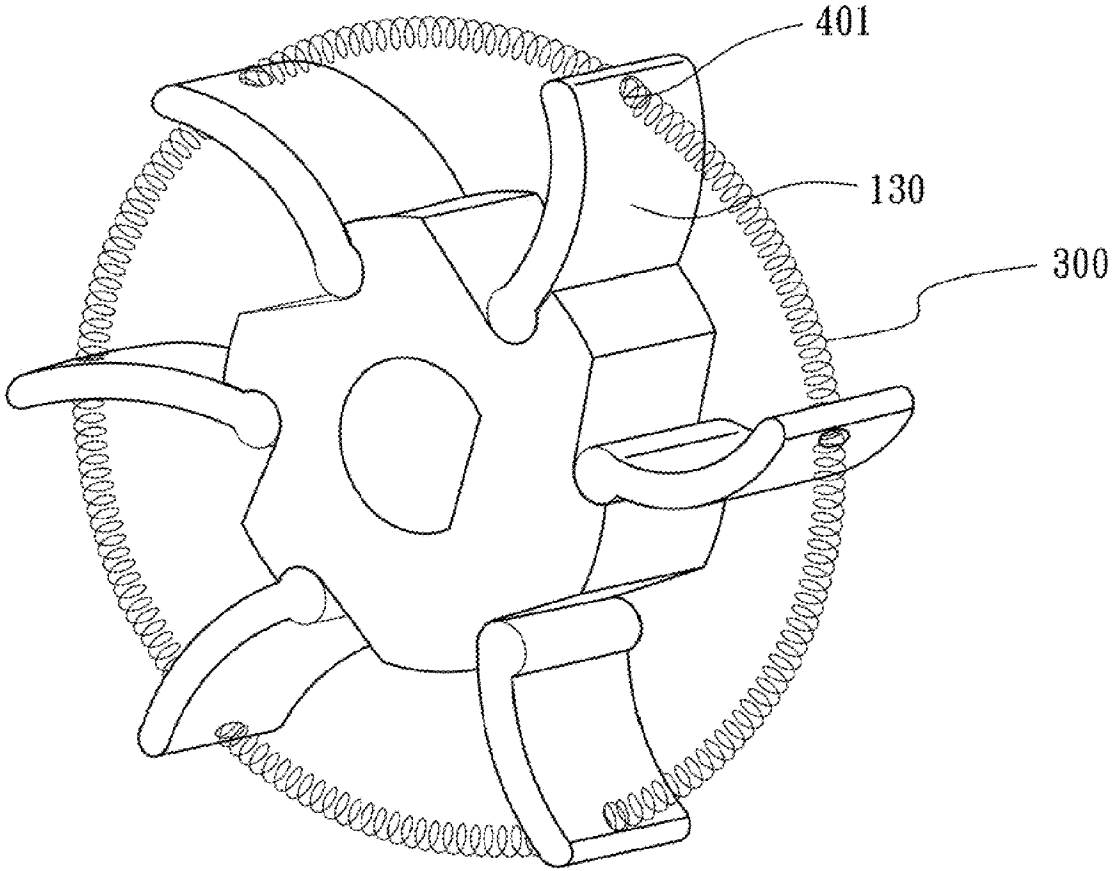
FIG. 4 is a three dimensional view of a bicycle trainer according to a part of still another embodiment of the present disclosure.

FIG. 4 is a three dimensional view of a bicycle trainer according to a part of another embodiment of the present disclosure. Each vane 130 includes a linking part 401, and the linking part 401 is a hole for holding the elastic member 300. The elastic member 300 is stably positioned in the hole and hoops the vanes 130. Therefore, the vanes 130 can be restricted stably.

Figure 5:
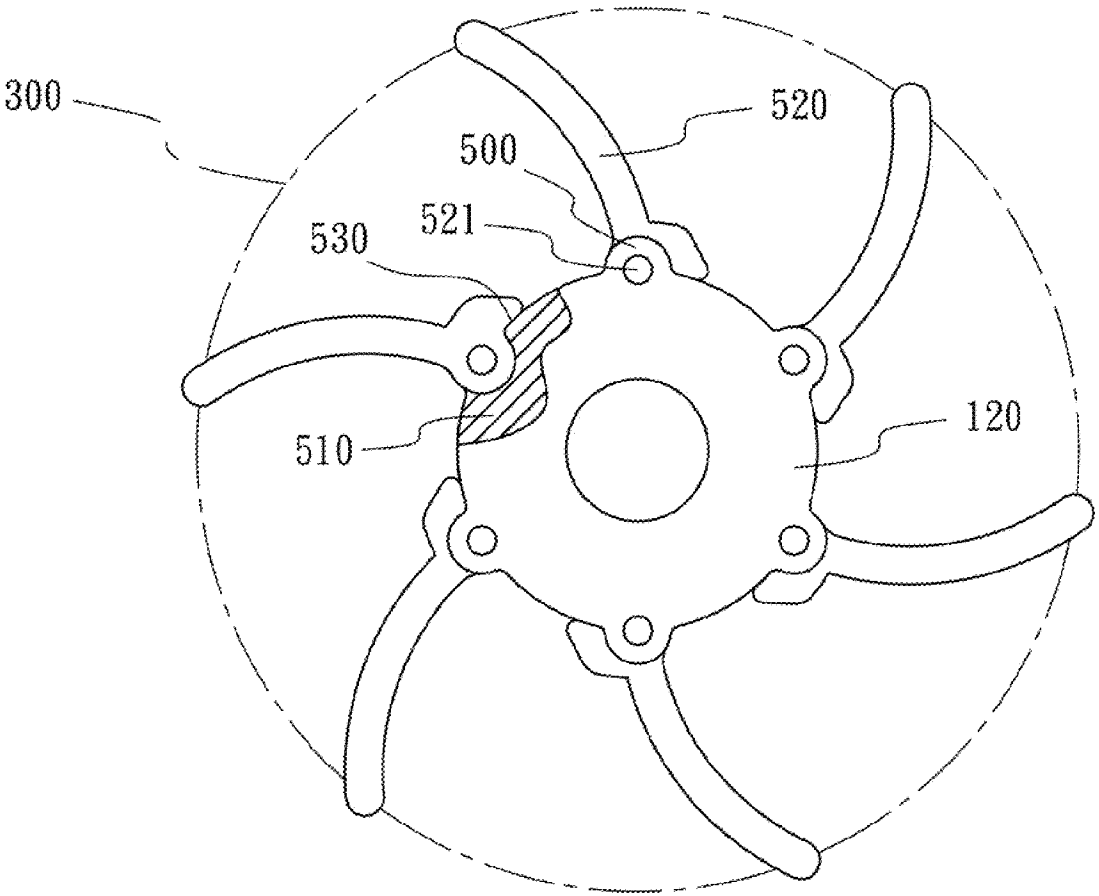
FIG. 5 is a plan view of a bicycle trainer according to a part of yet another embodiment of the present disclosure wherein a part of the plan view is a cross-sectional view.

Referring to FIG. 5 for a top plan view of a bicycle trainer according to a part of another embodiment of the present disclosure, wherein a part of the plan view is a cross-sectional view showing the interior of the pivot part 510.

The runner 120 includes a plurality of prominent parts 500 and a plurality of pivot parts 510. The vanes 520 are pivotally connected to the pivot parts 510 via a rotating shaft 521 respectively. The vanes 520 can rotated with the runner 120. The angle the vane 520 swinging outward from the center of the runner 120 is restricted by the medium in the housing 140 (in FIG. 1). The angle mentioned above is also restricted by the pivotal end of the vane 520 and the resistant part 530 on the edge of the runner 120. The resistant part 530 can prop the end of the vane 520, thus limiting the maximum angle between the edge of the runner 120 (or the resistance part 530) and the vane 520. Besides, the elastic member 300 resiliently hoops the vanes 520. It can increase the resistance to restrict the vane 520. Therefore, it can increase the reality of the simulation.

According to the embodiments of the prevent disclosure, there are some advantages.

1. When the user pedals the bicycle, the bicycle wheel 150 drives the roller 110. The roller 110 links up with the runner 120 to rotate. There is a centrifugal force, which is an outward force away from the center of rotation. The vane 130 and 530 were driven to swing outward from the center of the runner 120 by the centrifugal force, thus increasing the resistance when the user pedaling the bicycle trainer. The variation of the resistance can be illustrated as a smooth parabola. Therefore, it not only improves the sense of reality, but also induces the user to pedal the bicycle trainer with gradually increased resistance. It can prevent the user from injury resulted from pedaling the bicycle too hard.

2. The elastic member 300 can make each of the vanes 130 swings outward from the center of the runner evenly and equally, thus improving the stability of the bicycle trainer when it is pedaled by the user. Due to the foregoing mechanism, the unevenness between each of the vanes 130 has been eliminated. Therefore, the mechanism according to the present disclosure can remarkably decrease the failure rate of the vanes 130, the runner 120 and the roller 110, thus increasing the stability when pedaling the bicycle trainer.

What is claimed is:

1. A bicycle trainer, comprising:

a supporting frame for suspending at least one bicycle wheel;

a roller connected to the supporting frame via a shaft member, wherein the roller is driven by the bicycle wheel;

a runner coaxially connected to the roller via the shaft member;

at least one vane pivotally connected to an edge of the runner, and at least one elastic member for restraining the vane, wherein the elastic member surrounds the runner and resiliently hoops the vane.

2. The bicycle trainer of claim 1, further comprising:

at least one linking part located on the vane for connecting the elastic member.

3. The bicycle trainer of claim 2, wherein the linking part is a trough or a hole for holding the elastic member.

4. The bicycle trainer of claim 1, wherein the runner comprises:

at least one pivot part located on the edge of the runner, and the vane pivotally connected thereon.

5. The bicycle trainer of claim 4, further comprising:

at least one rotating shaft for pivotally connecting the vane to the pivot part.

6. The bicycle trainer of claim 1, further comprising:

a housing for containing the runner and the vane.

7. The bicycle trainer of claim 6, further comprising:

a damping liquid for filling the housing.

* * * * *